US007858131B2

(12) United States Patent
Billmann et al.

(10) Patent No.: US 7,858,131 B2
(45) Date of Patent: Dec. 28, 2010

(54) METHOD AND APPARATUS FOR DATING A FOOD PRODUCT

(75) Inventors: Clint R. Billmann, New Holstein, WI (US); Dale W. Arnold, Plymouth, WI (US); Erik A. Larson, Niceville, FL (US)

(73) Assignee: Johnsonville Sausage, LLC, Sheboygan Falls, WI (US)

( * ) Notice: Subject to any disclaimer, the term of this patent is extended or adjusted under 35 U.S.C. 154(b) by 449 days.

(21) Appl. No.: 11/768,612

(22) Filed: Jun. 26, 2007

(65) Prior Publication Data

US 2009/0001146 A1 Jan. 1, 2009

(51) Int. Cl.
*A23G 3/28* (2006.01)

(52) U.S. Cl. ..... 426/383; 426/393; 53/411; 53/131.2; 206/459.5; 206/499; 206/771; 206/114

(58) Field of Classification Search ..... 53/127, 53/131.2, 135.7, 136.1, 137, 411, 415; 426/383, 426/393; 206/459.5, 499, 771, 774
See application file for complete search history.

(56) References Cited

U.S. PATENT DOCUMENTS 1,935,671 A * 11/1933 Schmitt ..... 101/35
2,129,701 A * 9/1938 Malocsay ..... 206/271
2,216,884 A 10/1940 Kott
2,516,783 A 7/1950 Matter
2,620,961 A 12/1952 Wahl et al.
2,890,560 A 6/1959 Nigrelli et al.
2,915,868 A 12/1959 Copping
2,916,859 A 12/1959 Klein
2,918,773 A 12/1959 Krupp et al.
2,929,183 A 3/1960 Magna
2,982,075 A 5/1961 Foster
2,982,076 A 5/1961 Shelton
3,191,769 A * 6/1965 Schroder ..... 206/499
3,224,165 A 12/1965 Nigrelli et al.
3,392,501 A * 7/1968 Gilchrist, Jr. ..... 53/411
3,411,697 A * 11/1968 Hightower et al. ..... 229/240
3,777,445 A * 12/1973 Anderson ..... 53/397
3,852,942 A 12/1974 Johnson et al.
3,872,966 A * 3/1975 Gordon et al. ..... 206/772
4,191,005 A 3/1980 Vinoskey
4,462,851 A 7/1984 Colgate, Jr.
4,478,023 A 10/1984 Becker
4,522,014 A 6/1985 Robinson
4,543,767 A 10/1985 Wiseman
4,969,305 A 11/1990 York et al.
5,054,262 A 10/1991 Hertel et al.
5,269,742 A 12/1993 Crouch et al.
6,098,375 A 8/2000 Button et al.
6,688,074 B1 2/2004 Button et al.
6,718,730 B1 4/2004 Button et al.
6,877,609 B2 * 4/2005 Barker et al. ..... 206/722
6,878,222 B1 * 4/2005 Os ..... 156/64

* cited by examiner

*Primary Examiner*—Rena L Dye
*Assistant Examiner*—Chaim Smith
(74) *Attorney, Agent, or Firm*—Brian G. Gilpin; Godfrey & Kahn, S.C.

(57) ABSTRACT

A method of dating a food product that includes packaging at least two packages of a food product into a storage container and after packaging the at least two packages, the method further includes making the at least two packages with a date while the at least two packages are located within the storage container.

7 Claims, 13 Drawing Sheets

METHOD AND APPARATUS FOR DATING A FOOD PRODUCT

BACKGROUND

The present invention relates to marking food products, and more specifically, marking products with a date.

Often, food products are placed into packages, and the packages are marked with a date that determines the date by which the food product should be used or sold. The date is often referred to as a "sell by date," "expiration date," or a "best if used by date." In one process, several packages of the food product are packaged into a larger storage container, such as a box. Afterwards, the box is placed into a freezer for a period of time until the food products within the box are shipped or sold. Often, when the box is removed from the freezer for shipment or sale, the food products within the box will be thawed and refrigerated. In such a process, the date of removing the box from the freezer determines the date marked on the package. Typically, after removing the box from the freezer, the packages that store the food products are removed from the box and marked with the date and repackaged into the box for shipment or sale.

SUMMARY

In one embodiment, the present invention provides a method of dating a food product. The method includes packaging at least two package of a food product into a storage container and, after packaging the at least two packages, the method further includes marking the at least two packages with a date while the at least two packages are located within the storage container.

In yet another embodiment, the invention provides a method of dating a food product that includes packaging a plurality of packages of a food product into a storage container through a first opening of the storage container and closing the first opening of the storage container. After packaging the plurality of packages and closing the first opening, the method further includes, marking the plurality of packages with a date while the plurality of packages are located within the storage container through a second opening of the storage container.

In yet another embodiment, the invention provides a cardboard box storage container that includes a base, a plurality of sidewalls that extend upwardly from the base and oriented generally normal to the base to define a storage area. The plurality of sidewalls each includes a first end coupled to the base ad a second end opposite the first end. The storage container further includes a first opening formed by the second ends of the plurality of sidewalls, a top flap that closes the first opening to inhibit access to the storage area, and a side flap formed in at least one of the plurality of sidewalls. The side flap is movable between a closed position to inhibit access to the storage area and a open position to facilitate access to the storage area.

Other aspects of the invention will become apparent by consideration of the detailed description and accompanying drawings.

Before any embodiments of the invention are explained in detail, it is to be understood that the invention is not limited in its application to the details on construction and the arrangement of components set forth in the following description or illustrated in the following drawings. The invention is capable of other embodiments and of being practiced or of being carried out in various ways. Also, it is to be understood at the phraseology and terminology used herein is for the purpose description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
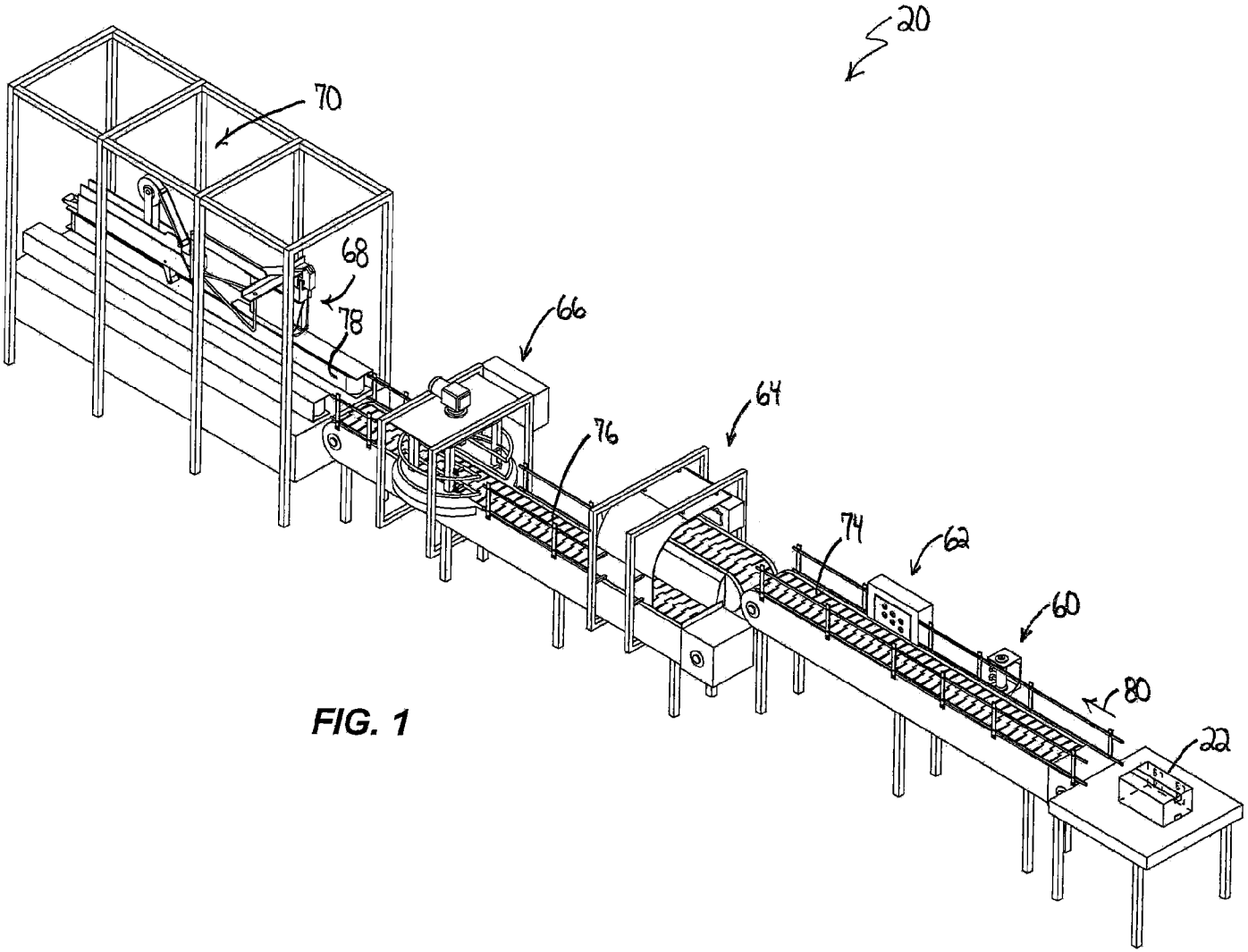
FIG. 1 is a perspective view of an apparatus for marking a food product embodying the present invention.

FIG. 1 illustrates a product marking assembly 20 for marking food packages stored within a storage container 22. While the illustrated product marking assembly 20 is particularly suited for marking food packages with a date, in other applications, the product marking assembly 20 can be used to mark any suitable product with other information.

Figure 2:
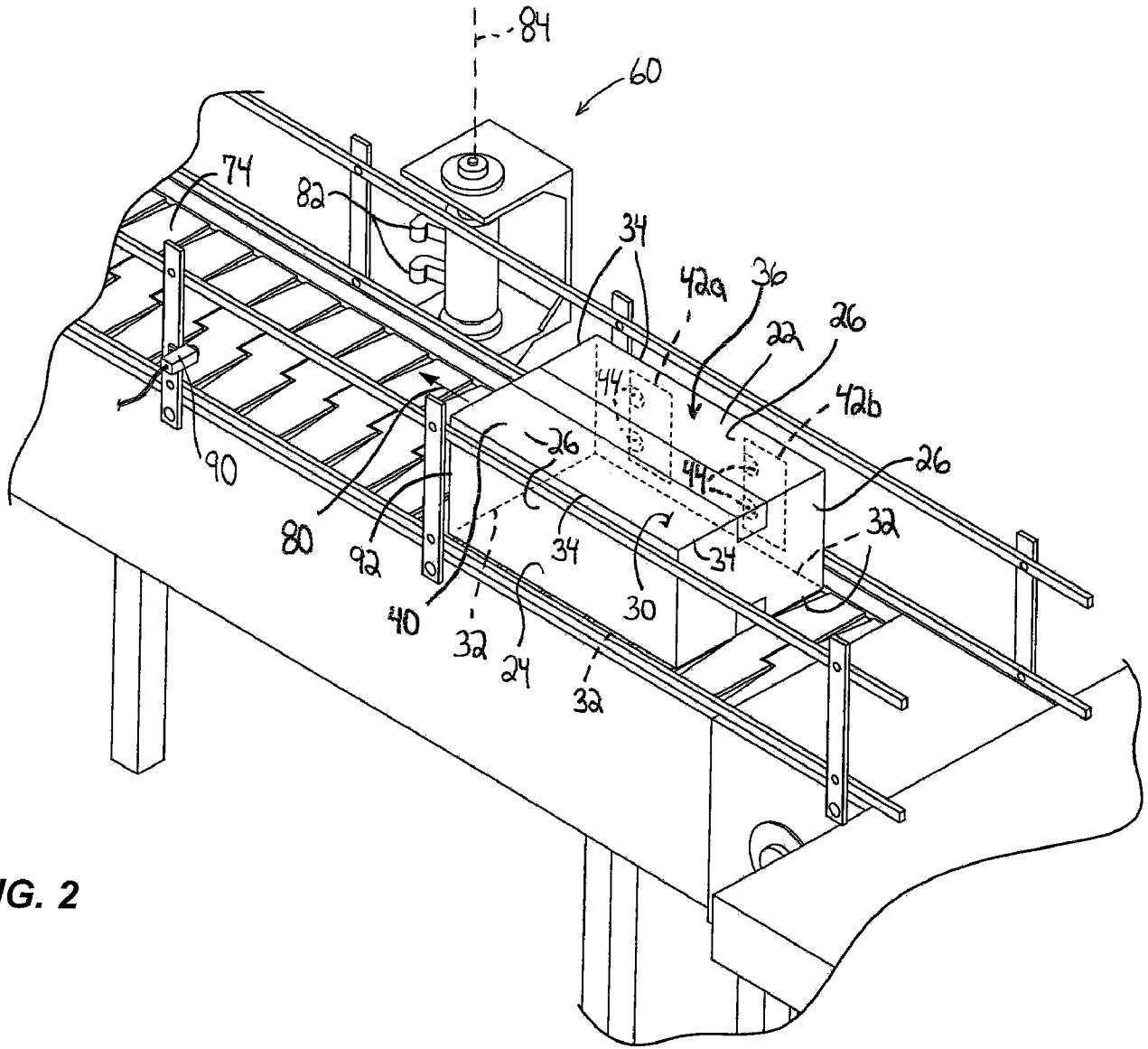
FIG. 2 is an enlarged front perspective view of a portion of the apparatus of FIG. 1 showing a storage container prior to opening.
Figure 13:
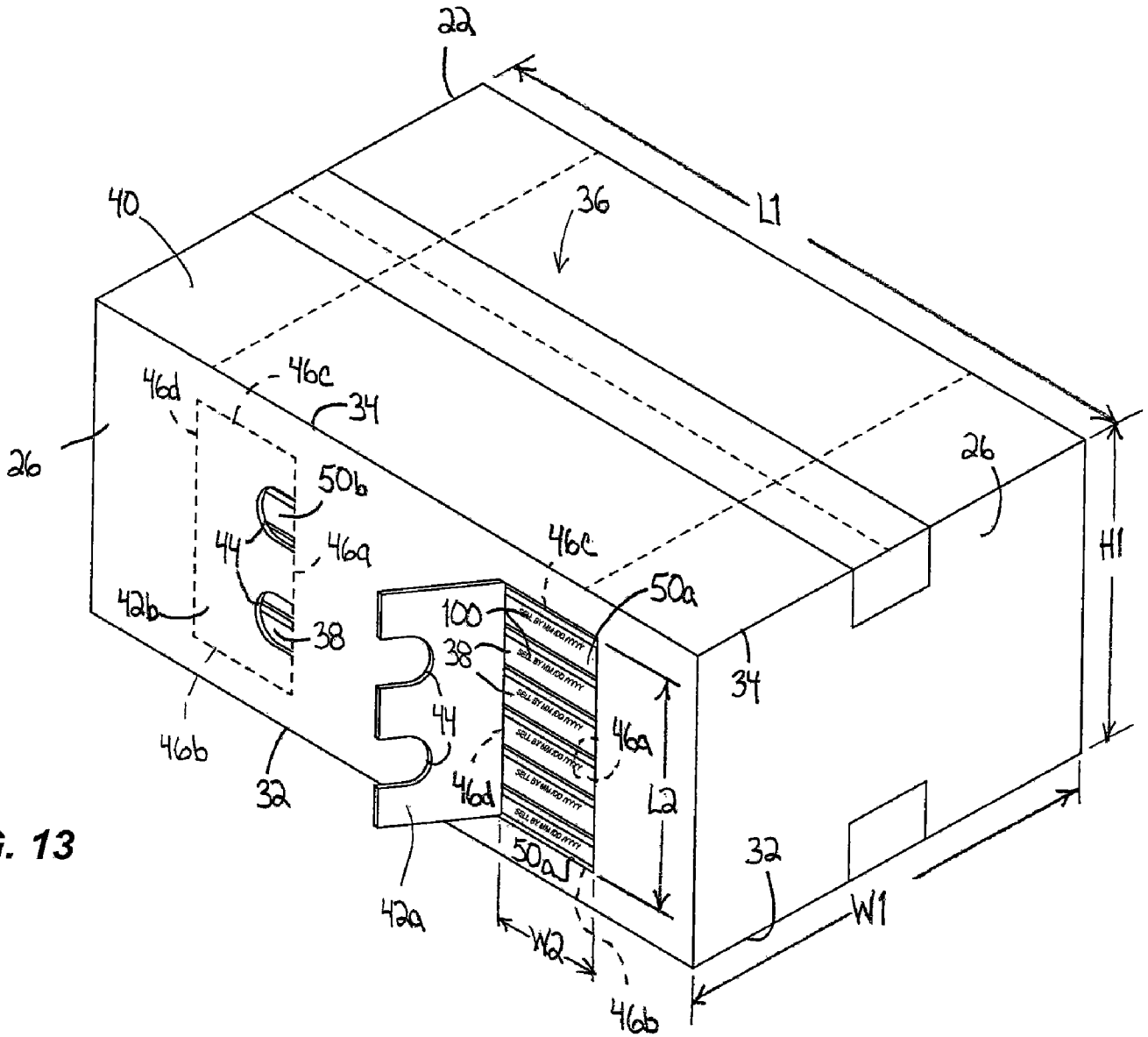
FIG. 13 is an enlarged perspective view of the storage container.

Referring to FIGS. 2 and 13, in the illustrated construction, the storage container 22 is a cardboard box that includes a base 24 and sidewalls 26 that extend upwardly from and normal to the base 24 to define a storage area 30. The sidewalls 26 each include a first end 32 coupled to the base 24 and a second end 34. The second ends 34 of the sidewalls 26 define a first or top opening 36 through which packages 38 are packaged into the storage container 22. The top opening 36 includes a length L1 and the width W1 that define an area of the top opening 36. As would be understood by one of skill in the art, a top flap 40 is coupled to the second ends 34 of the sidewalls 26 and the top flap 40 is utilized to close the top opening 36 of the storage container 22.

The storage container 22 further includes side flaps 42*a* and 42*b* and apertures 44 that extend through the sidewall 26. The illustrate flaps 42*a* and 42*b* are formed from perforated lines 46*a*, 46*b*, 46*c*, and 46*d* in the sidewall 26 of the storage container 22. The apertures 44 are located within a boundary created by the perforated lines 46*a*, 46*b*, 46*c*, and 46*d*. As will be discussed in more detail below, the apertures 44 are utilized to rotate the side flaps 42*a* and 42*b* about the perforated line 46*d*, which form a hinge for the flaps 42*a* and 42*b*. FIG. 13 illustrates the side flap 42*a* in an open position such that a side aperture 50*a* is created in the sidewall 26 and the side flap 42*b* in a closed position before being opened. The side aperture 50*a* has a length L2 and width W2 that define an area of the of the side aperture 50*a*. The area of the side aperture 50*a* is less than the area of the top opening 36, and in the illustrated construction, the area of the side aperture 50*a* is approximately ten percent of the area of the top opening 36. In other constructions, the area of the side aperture 500*a* is less than one-half of the area of the top opening 36.

In the illustrated construction, the storage container 22 includes two side flaps 42*a* and 42*b* that correspond to two stacks 54*a* and 54*b* of packages 38 located within the storage container 22. Accordingly, all of the food packages 38 be accessed for marking through the side apertures 50*a* or 50*b* (see FIG. 5). While the illustrated storage container 22 includes two side flaps 42*a* and 42*b*, in other constructions, the storage container can include any suitable number of side flaps.

Referring to FIG. 1, the product marking assembly 20 includes an opening device 60, a marking device 62, a flipping device 64, a rotating device 66, a closing device 68, and a sealing device 70. The opening device 60, the marking device 62, and the flipping device 64 are oriented along an upper conveyor 74. The rotating device 66 is located on a first lower conveyor 76. The closing device 68 and the sealing device 70 are located above a second lower conveyor 78. The conveyor 74, 76, 78 are operable to transport the container 22 in the direction of the arrow 80.

Figure 3:
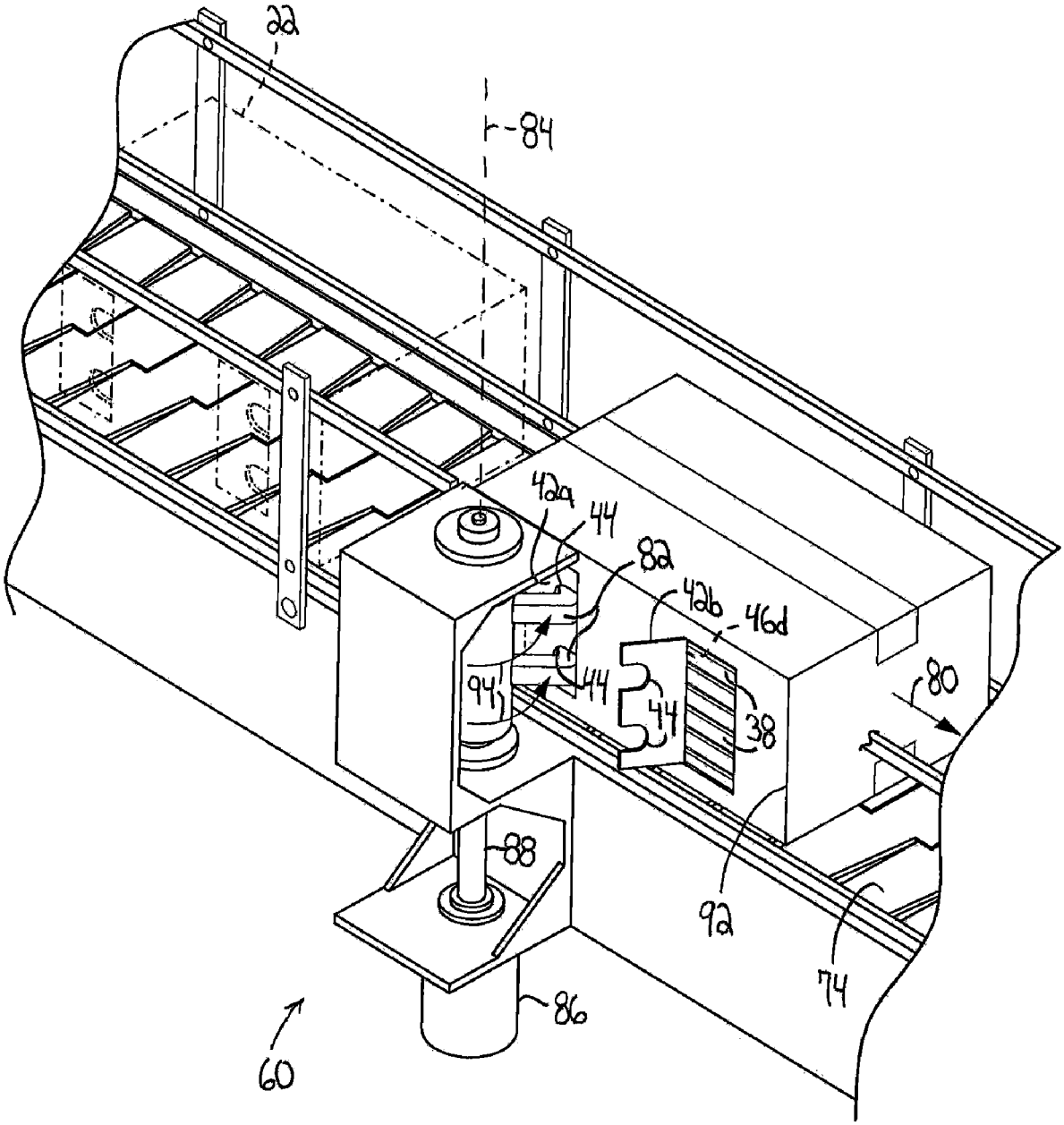
FIG. 3 is an enlarged rear perspective view illustrating the storage container with one door open and another door being opened.

Referring to FIG. 2 and 3, the illustrated opening device 60 includes two hooks 82 that rotate about an axis 84. The opening device 60 further includes a rotating member 86 and a shaft 88 that interconnects the hooks 82 and the rotating member 86. The rotating member 86 can be any suitable member, such as a motor, a combination of a motor and a spring, and the like that are operable to rotate the shaft 88. A position sensor 90 (FIG. 2) is coupled to the conveyor 74 adjacent the location of the opening device 60.

The sensor 90 determines when a leading edge 92 of the container 22 passes the hooks 82 of the opening device 60. After the leading edge 92 of the container 22 travels past the desired position, the hooks 82 are rotated in the direction of the arrows 94 of FIG. 3 such that the hooks 82 contact the sidewall 26 of the container 22 that faces the opening device 60. Meanwhile, the conveyor 74 continues to move the container 22 in the direction of arrow 80, and the hooks 82 move along the sidewall 26 of the container 22. When the apertures 44 align with the hooks 82, the hooks 82 move further in the direction of the arrows 94 such that the hooks 82 are received in the apertures 44. With the hooks 82 within the apertures 44, continued movement of the container 22 in the direction of the arrow 80 by the conveyor 74 tears the perforations 46*a*, 46*b*, and 46*c* (see FIG. 13) to create the side flap 42*a* that hinges along the perforated line 46*d*. Similarly, the container 22 continues to move in the direction of arrow 80 ad the opening device 60 opens the side flap 42*b*. Due to the geometry of the hooks 82, and the side flap 42*a*, the hooks 82 will disengage from the flap 42*a* after the flap 42*a* opens and in preparation for opening the other side flap 42*b*. After the sensor 90 detects that the container 22 has traveled past the opening device 60, the rotating member 86 rotates the hooks 82 in a direction opposite the arrows 94 such that the hooks 82 do not contact the leading edge of the next container.

Figure 4:
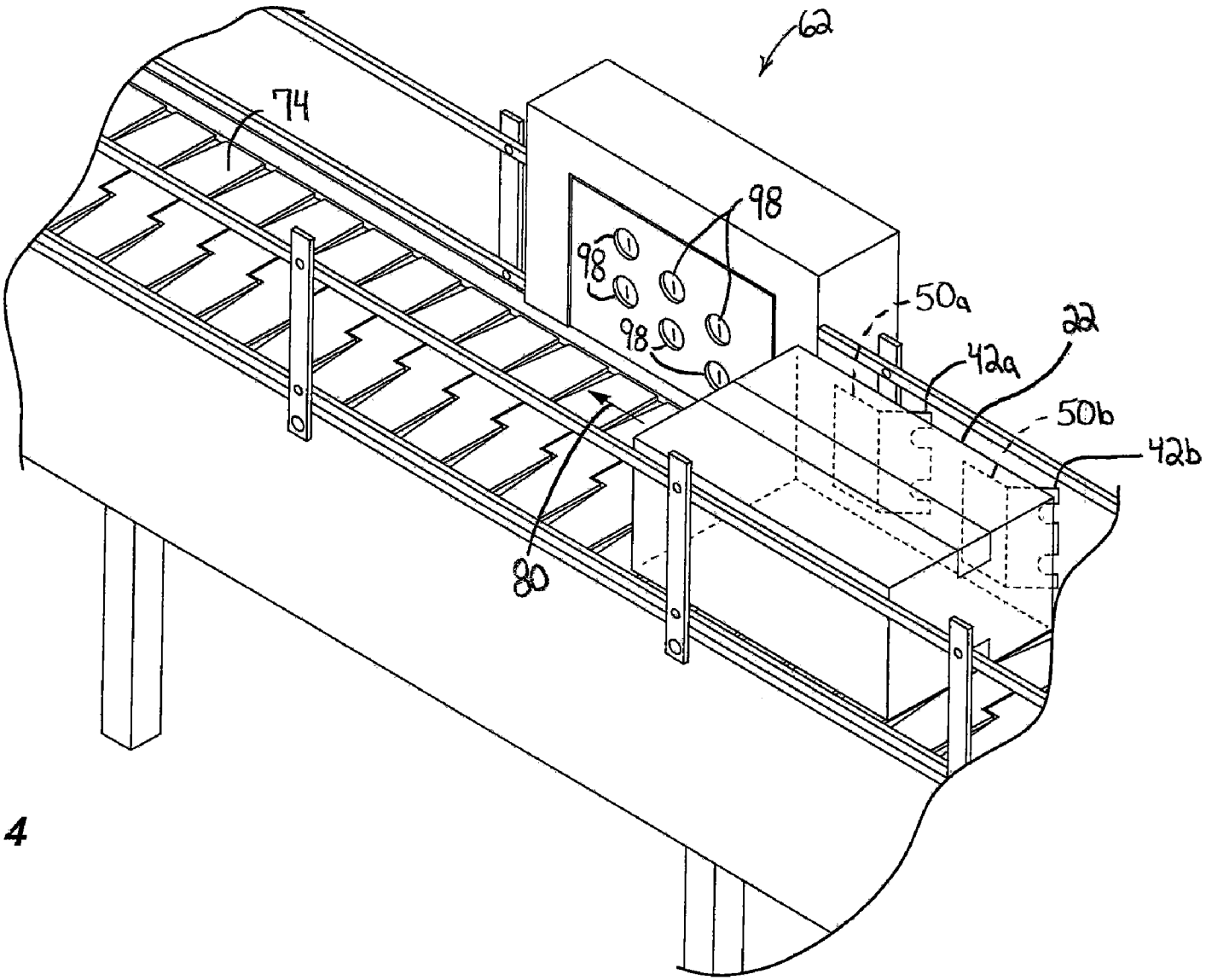
FIG. 4 is an enlarged front perspective view of a portion of the apparatus of FIG. 1 showing the storage container after being opened and prior to marking.
Figure 5:
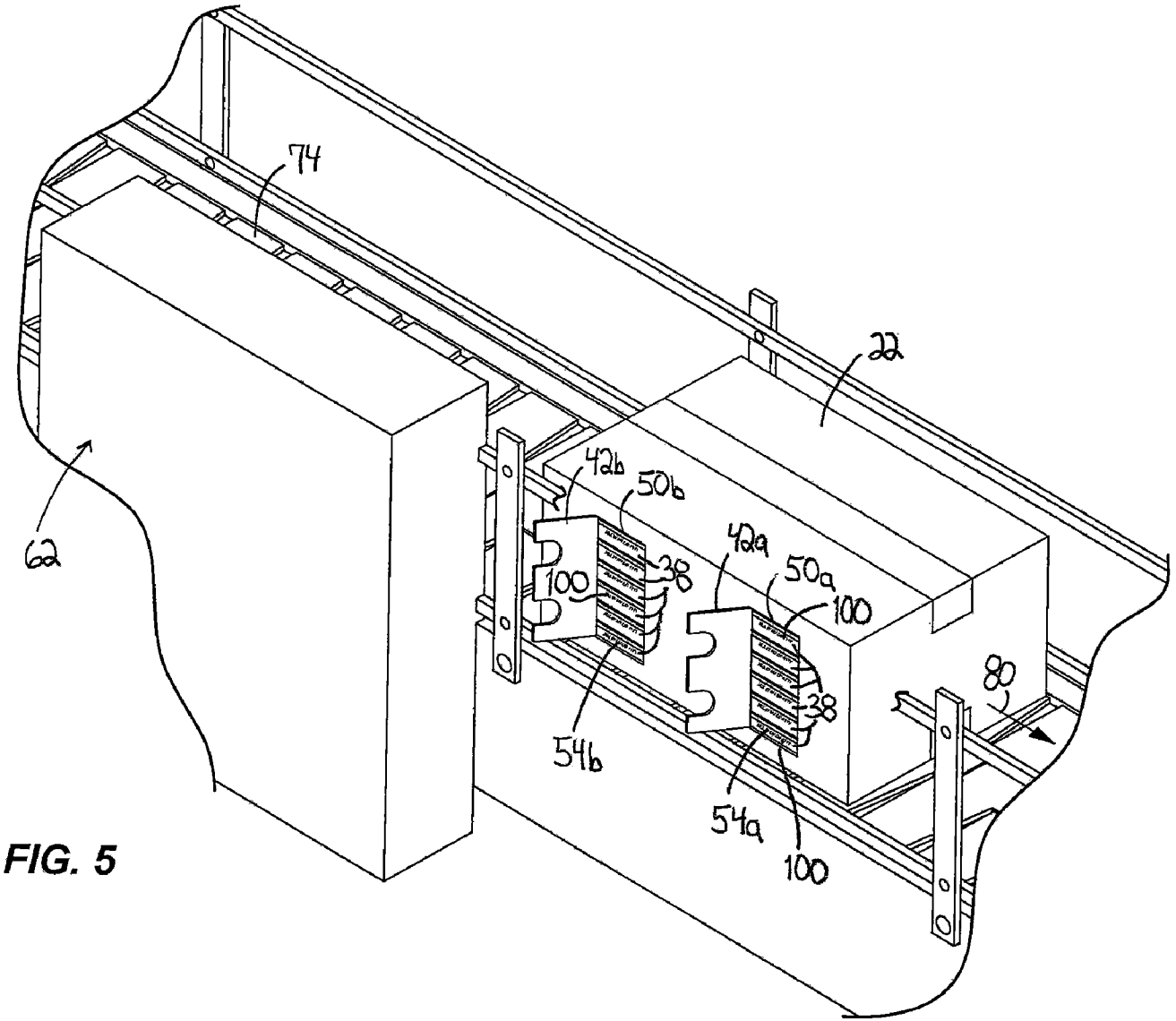
FIG. 5 is an enlarged rear perspective view illustrating the storage container and packages within the storage container after marking.

Referring to FIGS. 4 and 5, the illustrated marking device 62 includes six print heads 98 that are operable to mark packages 38 that are stored within the storage container 22. In the illustrated construction, the six print head 98 are vertically arranged to correspond to stacks 54*a* and 54*b* of six food packages 38 (see FIG. 5) that are stored within the storage container 22. Of course, in other constructions the marking device 62 can include any suitable number of print heads 98 depending on the number and arrangement of packages located within the storage container 22. While in the illustrate construction, the marking device 62 includes print heads 98 to mark the packages 38, in other constructions, other suitable devices, such as stamps and the like can be used to mark the packages 38.

The marking device 62 receives the container 22 with the side flaps 42*a* and 42*b* opened to create side apertures 50*a* and 50*b* respectively. As the apertures 50*a* passes the print heads 98, the print heads 98 each mark one of the packages 38 of the first stack 54*a* with a date 100 through the aperture 50*a*. Likewise as the aperture 50*b* passes the print heads 98, the print heads 98 each mark one of the packages 38 of the second stack 54*b* with the date 100 through the aperture 50*b*. The date 100 marked onto the packages 38 can be a future date that corresponds to a date by which food products within the packages 38 should be sold to the consumer, consumed, and the like.

Figure 6:
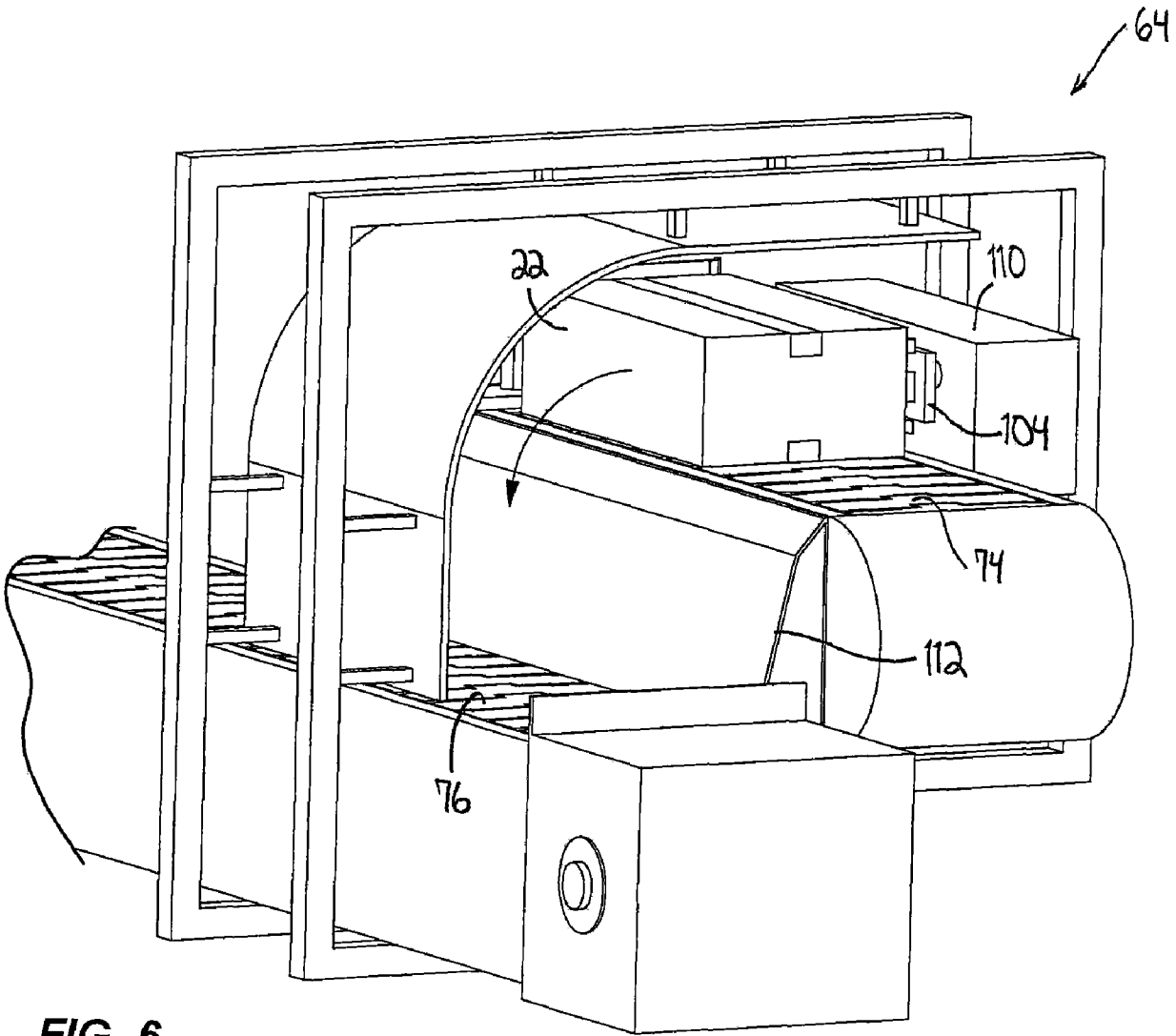
FIG. 6 is an enlarged perspective view of a portion of the apparatus of FIG. 1 illustrating a storage container flipping device with the store container in a first position.
Figure 7:
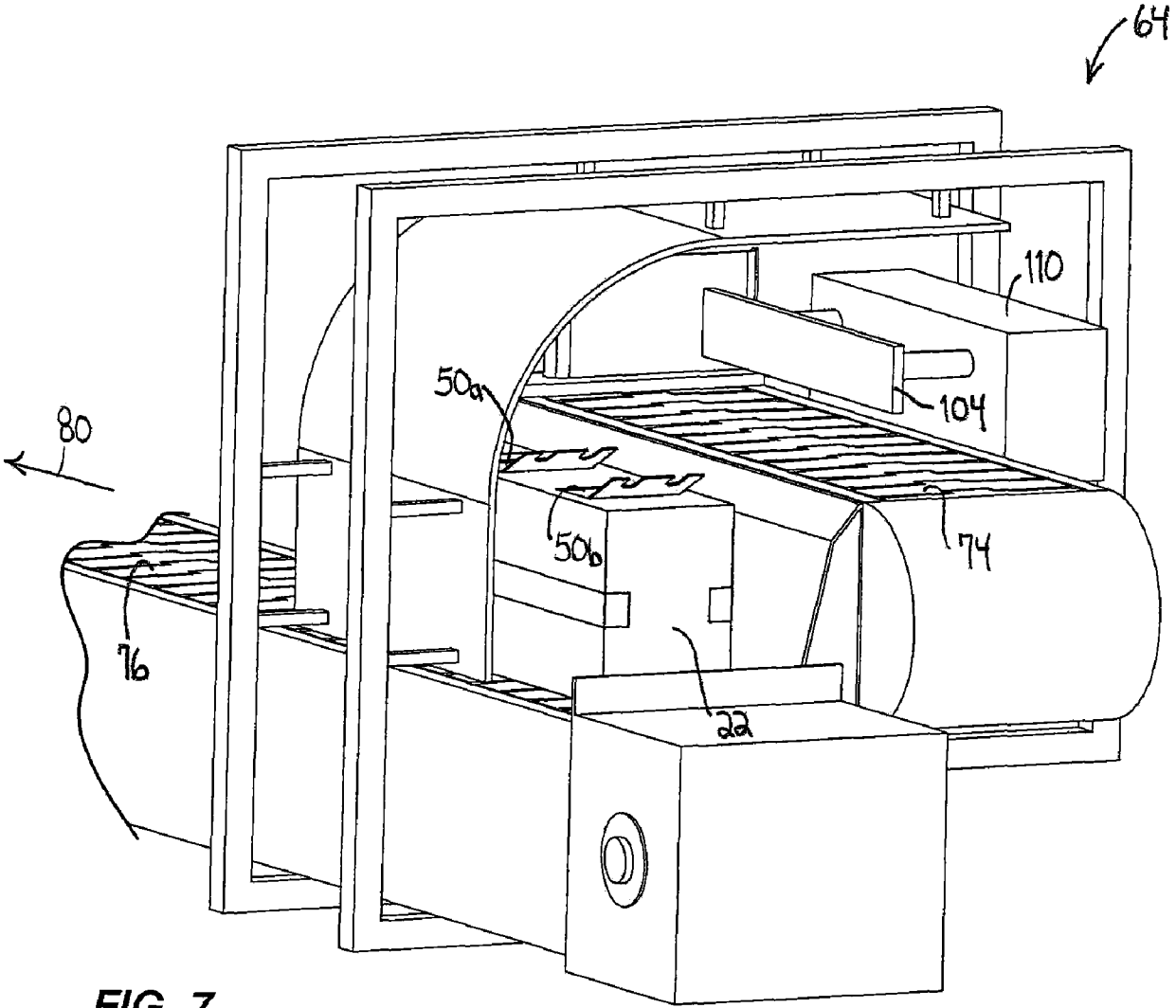
FIG. 7 is a view similar to FIG. 6 illustrating the storage container in a second position.

Referring to FIGS. 6 and 7, the flipping device 64 includes a horizontal bar 104 coupled to an actuator 110. The actuator 110 can be any suitable actuator, such as a pneumatic actuator, hydraulic actuator and the like. The actuator 110 is operable to move the horizontal bar 104 between the positions illustrated in FIGS. 6 and 7. A tape slide 112 is located between upper conveyor 74 and the first lower conveyor 76 adjacent the flipping device 64.

In the illustrated construction, after the packages 38 (FIG. 5) are marked by the marking device 62, the conveyor 74 transports the container 22 toward the flipping device 64. When the container 22 is adjacent the bar 104 of the flipping device 64, the bar 104 moves to the position illustrated in FIG. 7 to push the container 22 toward the lower conveyor 76. The slide 112 facilitates a smooth transition of the container 22 from the upper conveyor 74 to the lower conveyor 76. By moving from the upper conveyor 74 to the lower conveyor 76, the container 22 is flipped such that the apertures 50*a*, 50*b* are upwardly facing (see FIG. 7). Then, the lower conveyor 76 transports the container 22 in the direction of arrow 80 toward the rotating device 66.

Figure 8:
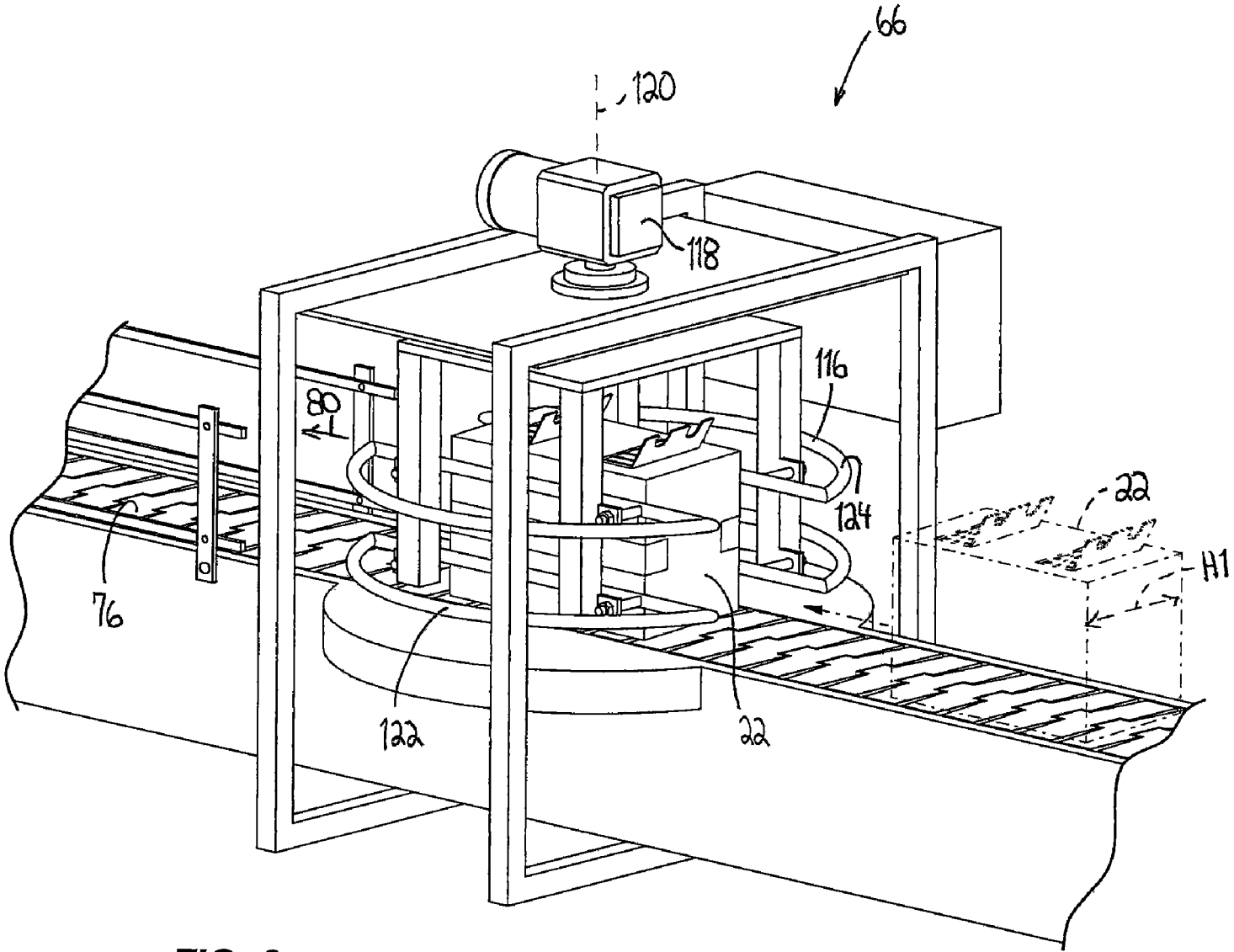
FIG. 8 is an enlarged perspective view of a portion of the apparatus of FIG. 1 illustrating a storage container rotating device and the storage container in a first position.

Referring to FIG. 8, the rotating device 66 includes a cage 116 and a drive member 118 that rotates the cage 116 about an axis 120. The cage 116 includes a first half 122 located on a left side of the conveyor 76 and a second half 124 located on a right side of the conveyor 76. The first and second halves 122 and 124 of the cage 116 are separated a distance slightly greater than a height H1 of the storage container 22. Therefore, the storage container 22 can pass through the cage 116 on the conveyor 76 in the position illustrated in FIG. 8. The drive member 118 can be any suitable drive member, such a motor, hydraulic actuator, pneumatic actuator, and the like that is operable to rotate the cage 116 about the axis 120.

Figure 9:
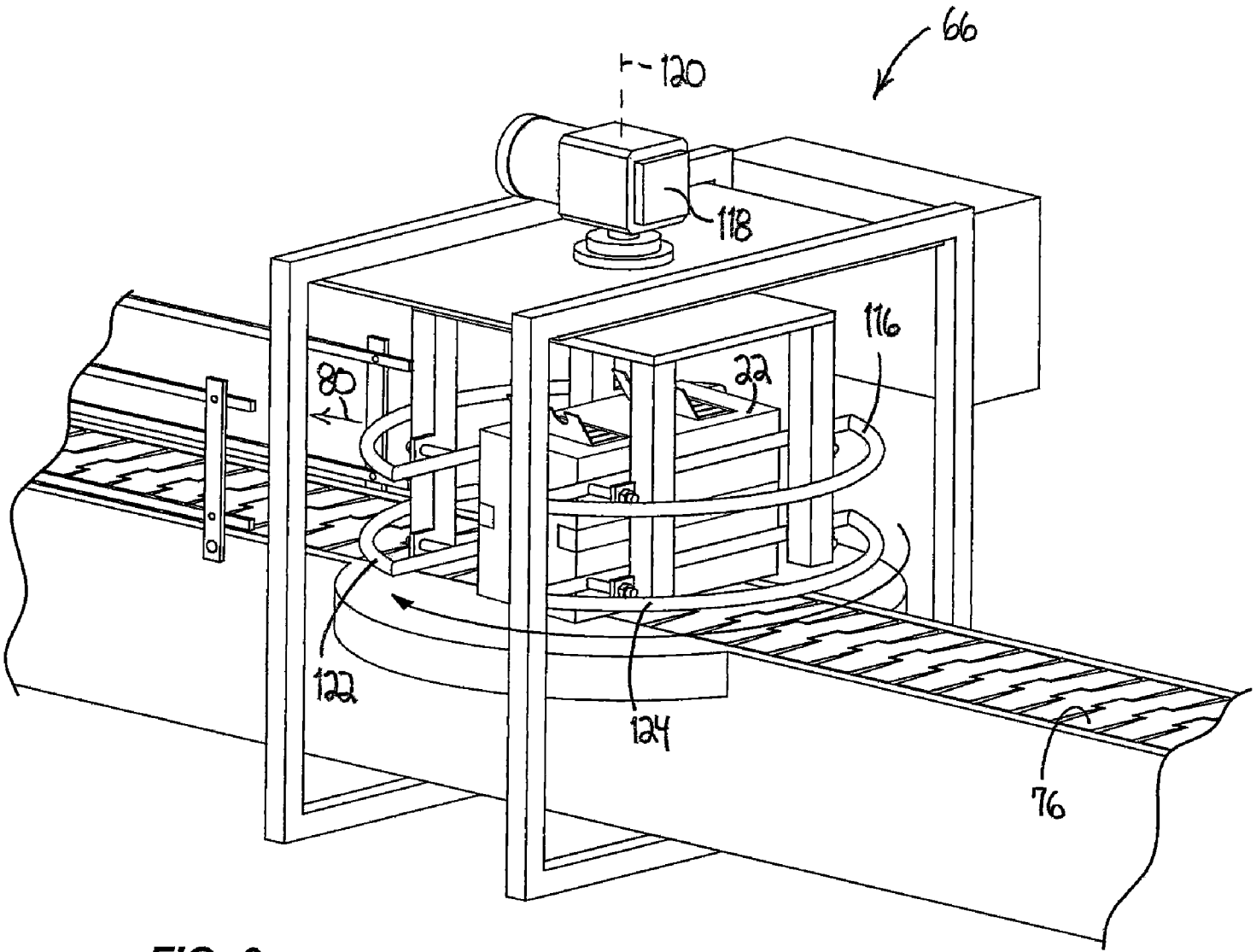
FIG. 9 is a view similar to FIG. 8 illustrating the storage container in an intermediate position between the first position and a second position.
Figure 10:
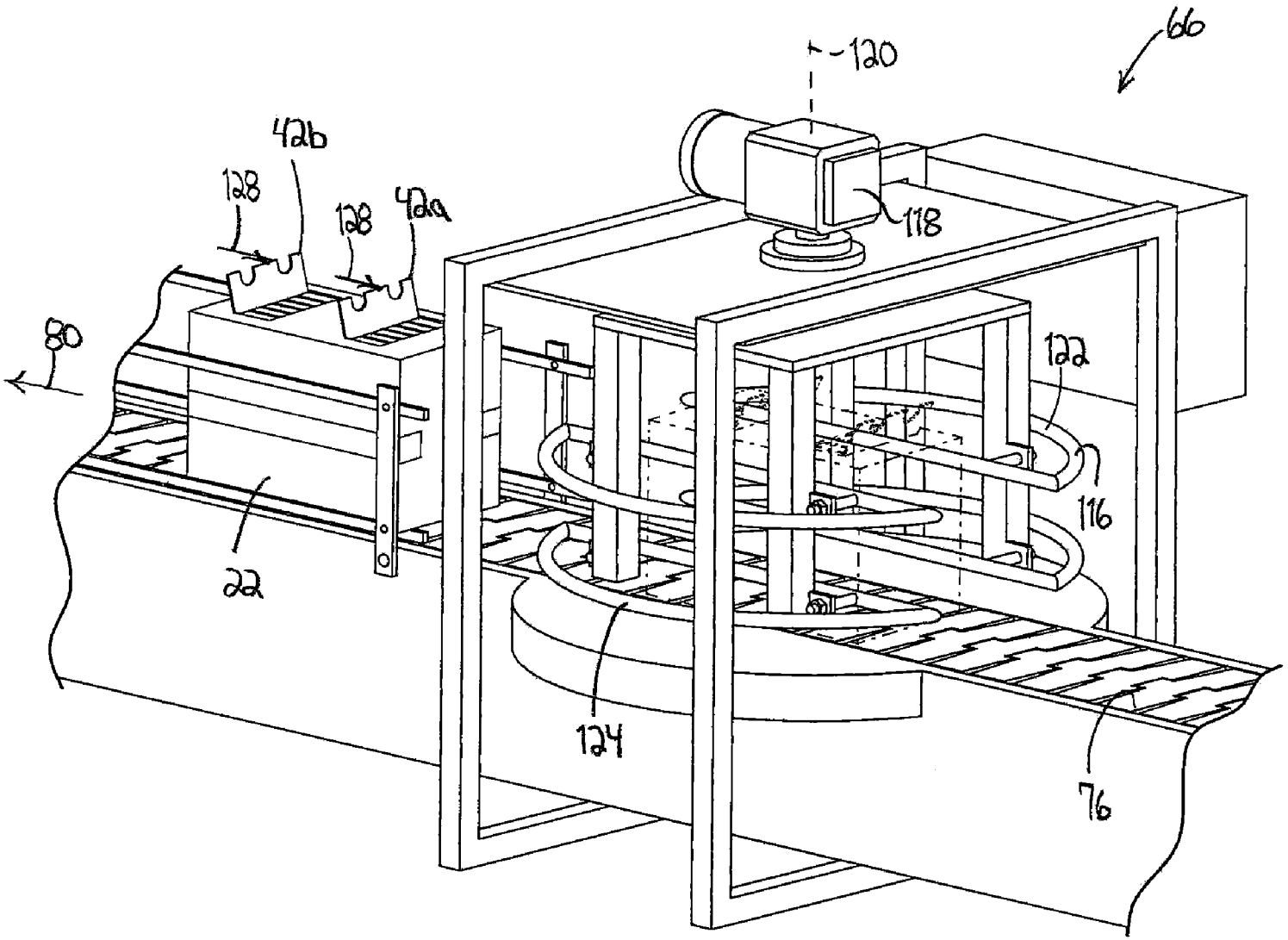
FIG. 10 is a view similar to FIG. 8 illustrating the storage container in the second position exiting the rotating device.

Referring to FIGS. 8-10, when the container 22 is positioned between the first and the second halves 122 and 124 of the cage 116, as illustrated in FIG. 8, the drive member 118 rotates the cage 116 about the axis 120. Rotation of the cage 116 rotates the container 22 approximately 180 degrees such that the closing direction of the side flaps 42*a*, 42*b*, generally indicated by the arrows 128 of FIG. 10, is opposite the direction that the conveyor 76 transports container 22, indicated by the arrow 80.

Figure 11:
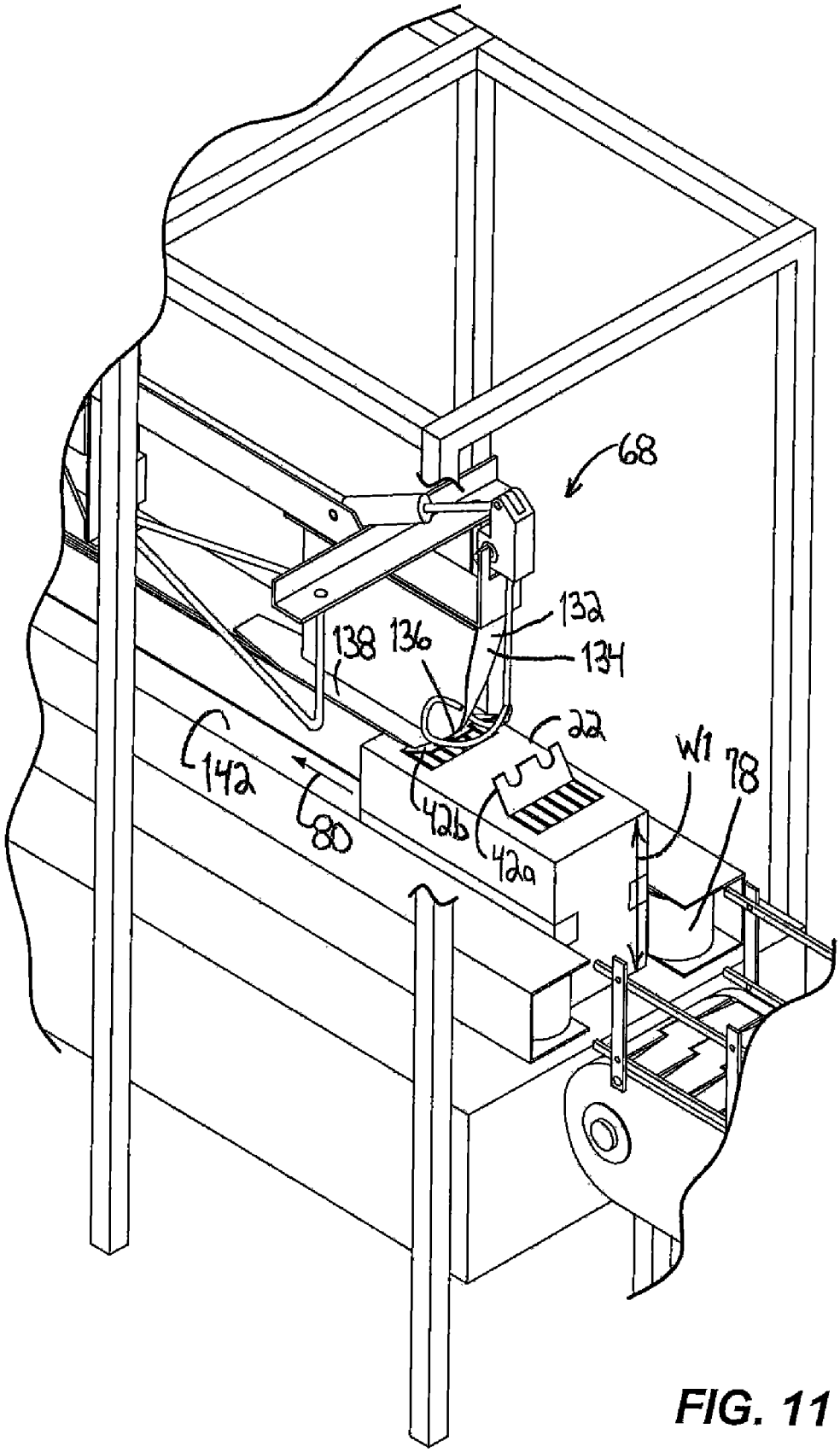
FIG. 11 is an enlarged perspective view of a portion of the apparatus of FIG. 1 illustrating a door closing device.

Referring to FIG. 11, the closing device 68 includes a flap closing member 132 having a tapered front portion 134, a curved transition 136 and a generally flat bottom portion 138. The bottom portion 138 of the flap closing member 132 is located a distance above a table surface 142 of the second lower conveyor 78 approximately the width W1 of the storage container 22.

As the container 22 continues to travel in the direction of arrow 80 toward the closing device 68, the container 22 is received by the second lower conveyor 78 and the second lower conveyor 78 continues to move the container 22 in the direction of arrow 80. As the container 22 moves in the direction of arrow 80, the flap closing member 132 contacts the side flaps 42*a* and 42*b* to close the slide flaps 42*a* and 42*b*.

Figure 12:
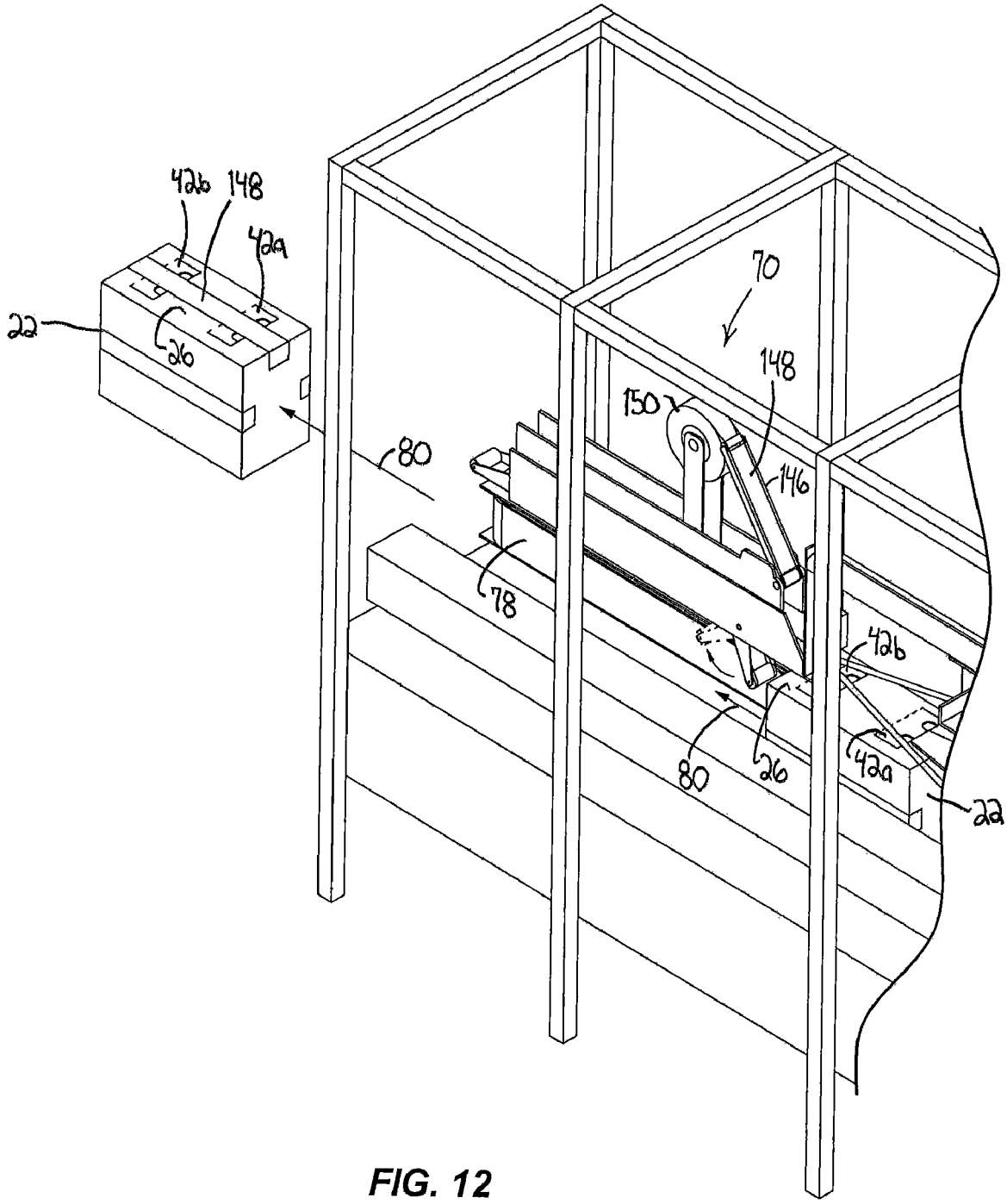
FIG. 12 is an enlarged perspective view of a portion of the apparatus of FIG. 1 illustrating a door sealing device.

Referring to FIG. 12, the sealing device 70 includes a tape application assembly 146 that is operable to apply tape 148 stored on a roll 150 to the storage container 22. Of course, in other constructions, the sealing device 70 may not utilize tape to seal the store container. Rather, in other constructions, adhesives and the like can be utilized to seal the storage container 22.

Referring to FIG. 12, with the side flaps 42*a* and 42*b* in the closed position, the conveyor 78 moves the container 22 in the direction of arrow 80 and underneath the sealing device 70. In the illustrated construction, the sealing device 70 applies tape 148 to the sidewall 26 of the container 22 to seal or hold the slide flaps 42*a* and 42*b* in the closed position. After the container 22 exits the conveyor 78, the container 22 can be shipped, sold, etc.

For some food products, the food products are froze after they are packaged and then thawed prior to shipment, sale, etc. Thawing the food product establishes a date in which the food product should be sold, consumed, and the like. Because the thawing date is unknown when the packages 38 are first packaged into storage container 22, the date 100 is marked on the packages 38 after the packages 38 are packaged into the storage container 22. The product marking assembly 20 marks the packages 38 through the side apertures 50*a* and 50*b*, and therefore, the packages 38 remain within the container 22 and the packages 38 do not have to be unpacked from the container 22. Thus, the top opening 36 (see FIG. 13) can remain closed while the packages 38 are marked. The side apertures 50*a* and 50*b* facilitate access to all of the packages 38 within the container 22 while the packages 38 remain packed within the container 22. Whereas, as best seen in FIG. 13, many of the packages 38 would be inaccessible for marking through the top opening 36 if the packages 38 remain packed within the container 22.

Referring to FIG. 13, in one method of operation, the packages 38, which contain a food product, are packaged into the storage container 22 through the first or top opening 36 as would be understood by one of skill in the art. Then, the top flap 40 is closed to cover the top opening 36 and the top flap 40 is taped or sealed closed. With the packages 38 of the food product in the storage container 22, the storage container 22 is placed into a freezer to freeze the food product until the packages 38 are shipped, sold, etc.

Prior to shipment, sale, etc, the storage container 22, which includes the packages 38, is removed from the freezer and refrigerated or thawed. Referring to FIGS. 1 and 2, after the storage container 22 is removed from the freezer or at any time prior to shipment, sale, etc., the container 22 is loaded onto the first lower conveyor 76. The first lower conveyor 76 transports the container 22 in the direction of arrow 80 of FIG. 2 toward the opening device 60. The opening device 60 opens the side flaps 42*a*, 42*b* of the container 22 to create the side apertures 50*a*, 50*b*. Referring to FIGS. 4 and 5, with the side flaps 42*a*, 42*b* open, the container 22 is transported by the conveyor 74 to the marking device 62. The marking device 62, using the print heads 98, marks of the packages 38 within the storage container 22 with the date 100.

Referring to FIGS. 1, 6, and 7, after marking, the container 22 is transported to the flipping device 64. The flipping device 64 pushes the container 22 off of the upper conveyor 74 and onto the lower conveyor 76, which flips the container 22 such that the side apertures 50*a*, 50*b* are upwardly facing. Referring to FIGS. 8-10, after being flipped, the container 22 is rotated approximately 180 degrees such that the closing direction, indicated by the arrows 128, of the flaps 42*a*, 42*b* is opposite the direction, indicated by arrow 80, that the container 22 travels.

Referring to FIG. 11, next, the conveyor 78 moves the container 22 under the flap closing member 132. The flap closing member 132 contacts the flaps 42*a*, 42*b* and pushes the flaps 42*a*, 42*b* toward the closed position while the conveyor 78 continues to move the container 22 in the direction of arrow 80. Referring to FIG. 12, after the flaps 42*a*, 42*b* are closed, the sealing device 70 applies tape 148 to the sidewall 26 of the container 22 to hold the flaps 42*a*, 42*b* in the closed position. As illustrated in FIG. 12, after being taped, the container 22 exits the conveyor 78 and is ready for shipment, sale, etc.

Thus, the invention provides, among other things, a product marking assembly that that is operable to mark packages with a date while the package remain packaged within a storage container. Various features and advantages of the invention are set forth in the following claims.

What is claimed is:

1. A method of dating a food product comprising:

packaging at least two packages of a food product into a storage container, wherein the storage container includes a base, a plurality of sidewalls that extend upwardly from the base and oriented generally normal to the base to define a storage area, the plurality of sidewalls each including a first end coupled to the base and a second end opposite the first end, a first opening formed by the second ends of the plurality of sidewalls, a top flap that closes the first opening to inhibit access to the storage area, and a side flap formed in at least one of the plurality of sidewalls, the side flap movable between a closed position to inhibit access to the storage area and an open position to facilitate access to the storage area; and wherein the following steps are preformed in sequence:

a. closing the top flap of the storage container;

b. placing the storage container, with the top flap closed, on a first conveyor;

c. transporting the closed storage container on the first conveyor to an opening device;

d. opening the side flap of the closed storage container with the opening device, exposing a portion of the at least two packages of food product;

e. transporting the storage container with the side flap opened on the first conveyor to a marking device;

f. marking the exposed portion of the at least two packages of food product in said storage container through said opened side flap with a date using the marking device;

g. moving the storage container containing at least 2 marked packages from the first conveyor to a second conveyor using a flipping device;

h. transporting the storage container on the second conveyor to a rotating device;

i. rotating the storage container approximately 180 degrees using the rotating device;

j. transporting the storage container to a closing device; and k. closing the side flap using the closing device.

2. The method of claim 1, wherein the opening device includes a rotating shaft, the shaft containing two hook members that rotate with the shaft wherein the shaft is positioned normal to the first conveyor and opening the side flap with the opening device includes the step of rotating hooks on the opening device to facilitate opening, wherein the hooks are received into apertures on the side flap.

3. The method of claim 1, further comprising the step of sealing the side flap.

4. The method of claim 1, wherein marking the exposed portions of the at least two packages of food product with a date includes the step of printing the date with at least one print head.

5. The method of claim 1, wherein the side flap has an area that is less than about one-half of an area of the top flap.

6. The method of claim 1, wherein the top flap remains closed during marking the at least two packages.

7. The method of claim 1, further comprising:

freezing the food product of the at least two packages after packaging the at least two packages; and before marking the at least two packages, removing the storage container from a freezer.

* * * * *